US006715308B2

(12) United States Patent
Grimm et al.

(10) Patent No.: US 6,715,308 B2
(45) Date of Patent: Apr. 6, 2004

(54) METHODS AND APPARATUS FOR PROVIDING A BANK OF FREEZERS WITH ENHANCED VIEWING CHARACTERISTICS

(75) Inventors: Thomas Ralph Grimm, Bella Vista, AR (US); Kenneth Paul Mounce, Bentonville, AR (US)

(73) Assignee: Wal-Mart Stores, Inc., Bentonville, AR (US)

( * ) Notice: Subject to any disclaimer, the term of this patent is extended or adjusted under 35 U.S.C. 154(b) by 0 days.

(21) Appl. No.: 10/164,458

(22) Filed: Jun. 6, 2002

(65) Prior Publication Data

US 2002/0189272 A1 Dec. 19, 2002

Related U.S. Application Data

(60) Provisional application No. 60/296,343, filed on Jun. 6, 2001.

(51) Int. Cl.[7] ..... A47F 3/04; F25D 11/02

(52) U.S. Cl. ..... 62/246; 62/446; 312/116

(58) Field of Search ..... 62/246, 249, 440; 312/114, 116, 107, 198, 199; 52/36.1; D6/432, 436, 440, 441, 442, 443, 449

(56) References Cited

U.S. PATENT DOCUMENTS

| | | | | |
|---|---|---|---|---|
| 2,554,610 A | | 5/1951 | Benson | |
| 2,878,090 A | | 3/1959 | Holderele et al. | |
| 4,433,880 A | | 2/1984 | Maravelas, Jr. et al. | |
| 4,818,043 A | | 4/1989 | Borgen | |
| 4,840,000 A | * | 6/1989 | Grines | 52/36.1 |
| 4,940,297 A | | 7/1990 | Borgen | |
| 5,626,028 A | * | 5/1997 | Graat et al. | 62/252 |
| 5,943,929 A | * | 8/1999 | Sebesta | 83/13 |
| 6,561,317 B1 | * | 5/2003 | Dudley | 186/38 |

* cited by examiner

*Primary Examiner*—William E. Tapolcai
(74) *Attorney, Agent, or Firm*—Priest & Goldstein, PLLC

(57) ABSTRACT

Techniques are described for improved line and clarity of sight for a freezer bank having multiple individual freezers. By selective angling of walls of the freezers, individual doors and the products behind those doors for two or more freezers can be more clearly seen with reduced glare. With this arrangement, more freezer doors can be as clearly seen as typical for product doors at an end of a row or an end of an aisle thereby improving the overall merchantability of a store's freezer section. Applications to a warehousing store environment are described in detail.

10 Claims, 10 Drawing Sheets

METHODS AND APPARATUS FOR PROVIDING A BANK OF FREEZERS WITH ENHANCED VIEWING CHARACTERISTICS

The present application claims the benefit of U.S. Provisional Application Ser. No. 60/296,343 entitled "Methods and Apparatus for Providing a Bank of Freezers with Enhanced Viewing Characteristics" and filed Jun. 6, 2001, which is incorporated by reference herein in its entirety.

FIELD OF THE INVENTION

The present invention relates generally to improved methods and apparatus for displaying frozen foods or other products displayed in freezers, dairy products and other items typically displayed in coolers, and like products requiring refrigeration displayed in refrigeration units to potential customers. More particularly, the present invention addresses techniques for creating a bank of freezers, coolers or other refrigeration units with advantageous lines of sight and improved clarity of viewability.

BACKGROUND OF THE INVENTION

The warehouse shopping experience has become both increasingly common and popular. A typical store providing such an experience has a relatively large floor plan or square footage. It also stocks a wide range of products which are often sold in bulk at reduced prices. As a result, a shopper instead of making separate trips to a department store, a drug store and a grocery store, for example, may advantageously make a single visit to his or her nearest Sam's Club™ store, for example. Rather than buying a four pack of toilet paper or a pound of hamburger at a premium per unit price, the shopper might buy a twenty pack of toilet tissue or a ten or more pound package of hamburger at significantly lower per unit prices.

In such environments, to the end of meeting customers' demands for frozen foods and other refrigerated items, it has been previously known to create relatively large banks of freezers in which glass display doors are arranged side by side with product display shelving arranged behind the doors and additional restocking shelving arranged above them to store products used to restock the freezers. This arrangement of shelves above the freezers facilitates rapid restocking of the freezers. With the restock storage arranged above the freezers, the height of the bank may be about 15 feet high so that it is impossible for a customer to see over the units. In these arrangements, forklifts to deliver product for restocking can enter at one end of each freezer, cooler, or refrigeration unit with an open area between the shelves and behind the doors which is wide enough to allow the forklifts to travel into the freezer or cooler to deliver restock items to the appropriate location.

A number of problems with such arrangements have been identified by the present inventors. Where a prior art arrangement of freezers employs several large rectangular freezers or coolers, one unit may block a customer's line of sight so that the customer does not become aware of other buying opportunities if he or she does not make a conscious effort to go up and down each aisle or row. Also, a limited number of end doors and end product locations are provided by existing rectangular arrangements which limits a store's ability to showcase to potential customers an item or items in high traffic, high visibility areas. Further, depending upon lighting conditions, a very long bank of glass doors all arranged in a straight line may produce a high level of glare when a customer attempts to look down the aisle at an angle so that missed sales opportunities result.

SUMMARY OF THE INVENTION

To the end of addressing such problems while preserving the advantageous aspects of existing arrangements as to storage of products for restocking, ready access to shelving for restocking and the like, a presently preferred embodiment of the present invention provides a relatively small footprint bank of freezers or coolers having multiple curved or angled walls of freezer or cooler doors. The overall bank of freezers or coolers advantageously has improved lines of sight. When compared with typical prior art approaches, it also includes an additional number of freezer, cooler, or other refrigeration units access doors which may have the higher visibility traditionally only provided by end units at the end of a row or aisle. Also, the angling of the walls of the freezers and coolers help to funnel customers, from a focal point of customer interest at the end of an aisle, down the aisle so that increased customer traffic and increased sales result. These and other advantages of the present invention will be apparent from the drawings and the Detailed Description which follow.

DETAILED DESCRIPTION

Figure 1:
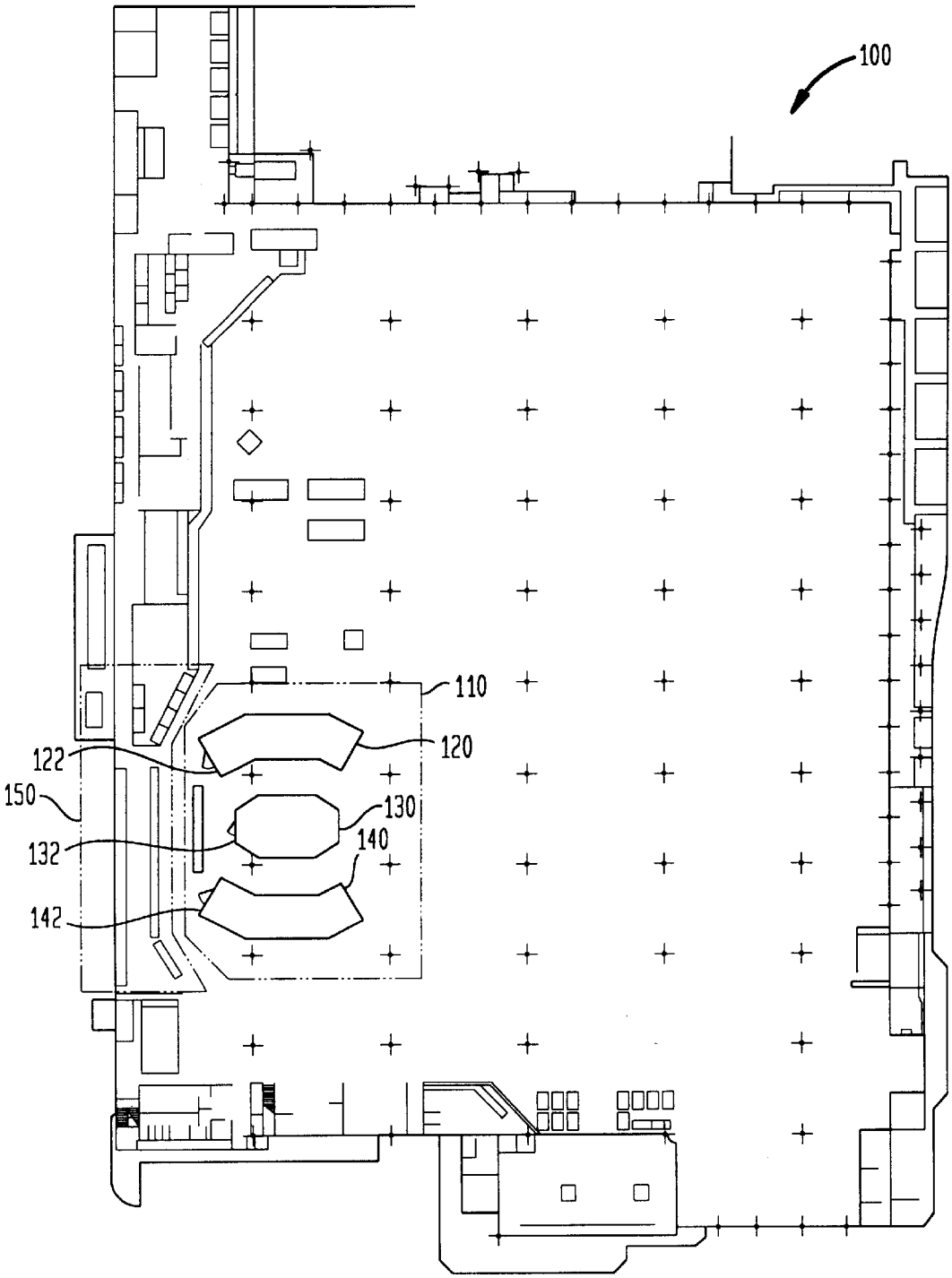
FIG. 1 shows an overall layout of a store incorporating a freezer or cooler bank in accordance with one embodiment of the present invention.

FIG. 1 shows an overall store floorplan 100 including a bank of freezers 110 in accordance with the present invention. The bank of freezers 110 includes three curved or angled freezers or coolers 120, 130, and 140, respectively. While it will be understood that each unit 120, 130, or 140 can be a freezer, a cooler, any other refrigeration unit or some combination thereof, the discussion which follows for the sake of simplicity will largely address the units as freezers. Each of the units includes at least one portion angled with respect to an immediately adjoining portion at an angle substantially different from 90°. As seen in FIG. 1, the freezers 120, 130, and 140 are freestanding and the ends 122, 132, and 142, respectively, are adjacent a C-shaped cooler 150 to form an overall freezer and cooler storage area with a large volume, a large number of doors, and a relatively small footprint. In a presently preferred first embodiment, the footprint of the bank or array of freezers 110 is approximately 9,500 square feet out of an overall square footage of over 150,000 square feet for store floor plan 100 for a Sam's Club™, or the like store.

Figure 2:
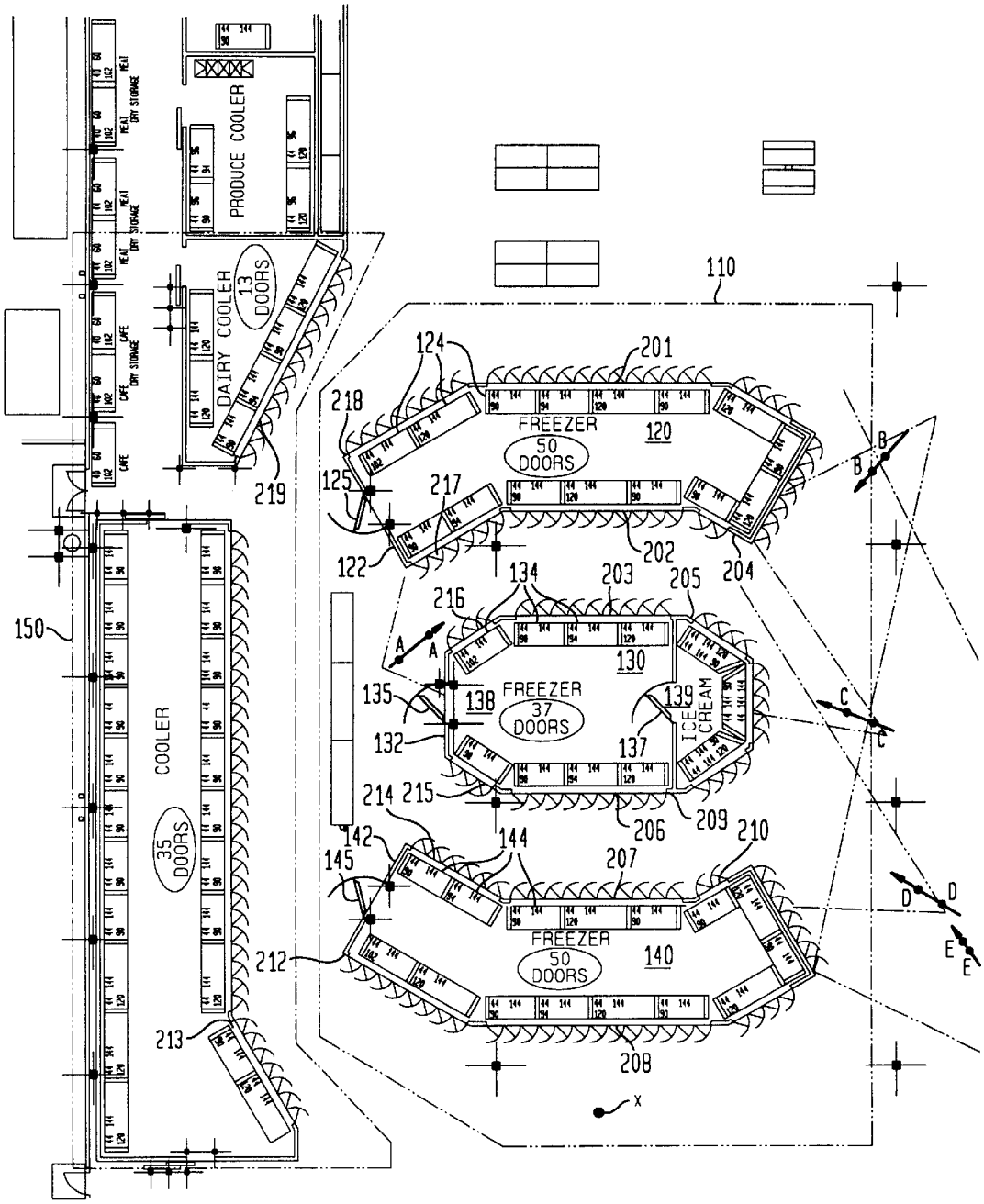
FIG. 2 provides a more detailed view of the freezer or cooler bank of FIG. 1.

FIG. 2 shows further details of the bank of freezers 110 of FIG. 1. As seen in FIG. 2, each of the freezers 120, 130, and 140, respectively, is formed from a plurality of individual storage compartments and doors 124, 134, 144, arranged as seen in FIG. 2. In the arrangement shown, each of the freezers has angled or curved portions to enhance viewability of products by shoppers as addressed further below. At the ends 122, 132, and 142, doors 125, 135, and 145 are provided to provide access for restocking of the respective freezers. In a warehouse club type of store, sufficient room is provided for a forklift to drive in between the interior of individual freezers in a known fashion.

In a presently preferred embodiment, the entirety of the interior of the freezers 120 and 140 is cooled as a single unit by cold air piped to the unit from a cooling unit outside the store. For the freezer 130, a further insulating door and wall 137 separates a frozen food section 138 from an ice cream section 139. The ice cream section is cooled to a lower or colder temperature than the frozen food section 138.

This arrangement is exemplary of the placement of a popular item such as ice cream on the end of a freezer and aisle where it will attract customer attention and hopefully draw customers down the aisles on either side. As discussed in greater detail below, the angled ends of freezers 120 and 140 closest to the ice cream section 139 of freezer 130 present many glass doors through which a customer can more clearly see additional products of possible interest, thus hopefully drawing the customer's interest and feet down the aisle.

In a presently preferred embodiment, freezer 120 has a width from point 201 to point 202 of nineteen feet and ten inches. The spacing between point 202 of freezer 120 and point 203 of freezer 130 is sixteen feet. The spacing between points 204 and 205 is fourteen feet and three inches. Freezer 130 has a width from point 203 to point 206 of twenty-eight feet. The spacing between points 206 and 207 of freezers 130 and 140 is sixteen feet and one inch. The width of freezer 140 between points 207 and 208 is nineteen feet and ten inches. The spacing between point 209 of freezer 130 and point 210 of freezer 140 is fourteen feet and three inches.

Freezers 120 and 140 have 50 doors each and freezer 130 has 37 doors. Cooler 150 has a first cooler section with 35 doors and a dairy cooler section having 13 doors. Point 212 of freezer 140 and point 213 of cooler 150 are spaced sixteen feet and one inch apart. Point 214 and point 215 of freezers 140 and 130, respectively, are preferably spaced thirteen feet and eight inches. Points 216 and 217 of freezers 130 and 120, respectively, are spaced by thirteen feet and eleven inches. Points 218 and 219 of freezer 120 and cooler 150, respectively, are spaced by thirteen feet and five inches. As will be recognized by those of ordinary skill in the art, other spacings and numbers of doors will of course be possible. A second exemplary embodiment is described in detail below in connection with FIG. 10.

As seen in FIGS. 3—8, the freezers 120, 130, and 140 are part of overall units having a front, facing, or housing that extends substantially above floor 160. In a presently preferred embodiment, this housing extends approximately fifteen feet about floor 160. The housing contains the cold air cooling the individual freezer display shelves or compartments. It also conceals additional restocking shelving. This restock shelving stores product to restock the display areas of the freezer display shelves located below the restock shelves in a known manner. The height of these units makes line of sight an important design consideration because unlike a typical retail environment, such as the jewelry counter of a department store where a customer can see over one display to another, a customer at point "X" in FIGS. 2 and 3 cannot see the freezers 120 and 130 as his or her view is completely blocked by the array 140.

Figure 3:
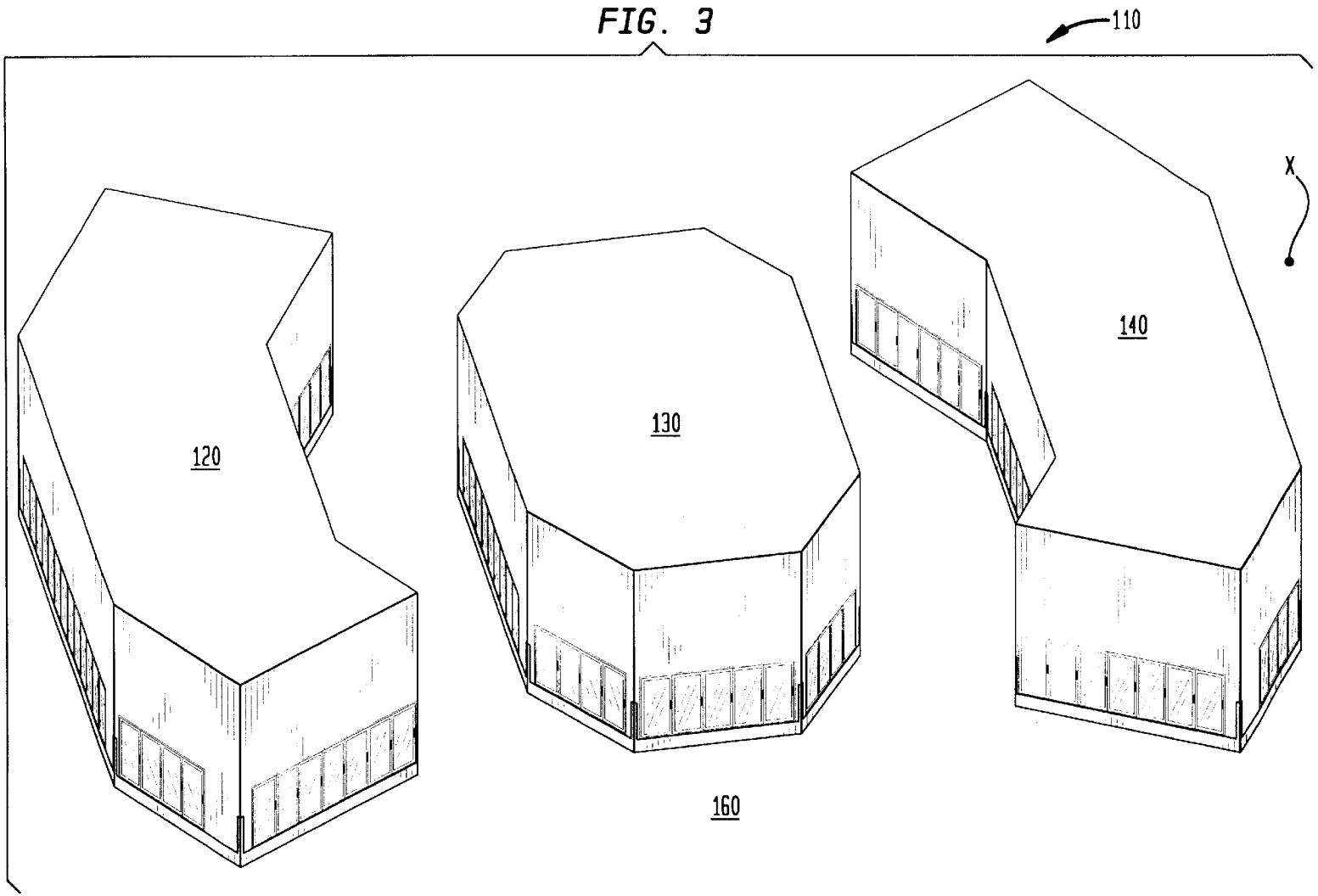
FIG. 3 shows a perspective view of the freezer or cooler bank of FIG. 1.
Figure 4:
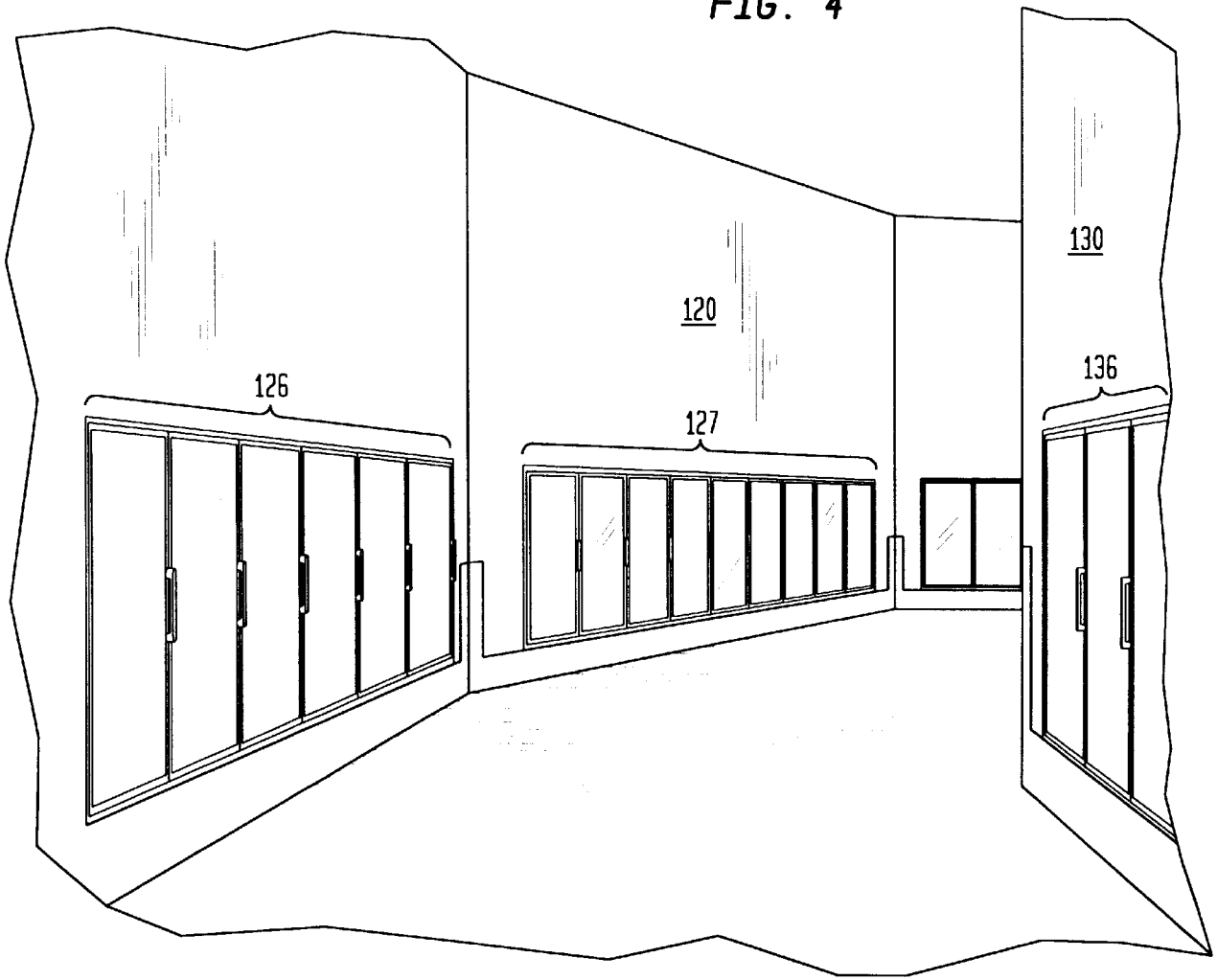
FIG. 4 shows details of a first and a second freezer or cooler of the bank of FIG. 1 from a point approximately located along the line of sight A—A of FIG. 2.

FIG. 3 shows an overall perspective view of the bank of freezers 110. FIG. 4 shows freezer 120 and freezer 130 viewed from a point located approximately along a line of sight A—A of FIG. 2. FIGS. 4—8 are taken from digital photos of a presently preferred embodiment of the present invention. The angle of view in these figures is the angle of view of the digital camera. As seen in FIG. 4, freezer doors 126 and 127 of freezer 120, as well as doors 136 of freezer 130 can be readily seen. By contrast, as seen for the bank of refrigerated units 800, shown in FIG. 9, which is comprised of equal length freezers 820 and 830 and cooler 840, line A' and A' passes through the freezer 830. The corner of freezer 830 cuts off much of any potential view of array 840. When a customer looks down the aisle between freezer 830 and cooler 840 from a point at the end of the aisle, such as point Y, the angle is such that glare may make it not possible to see what is behind the doors.

Figure 5:
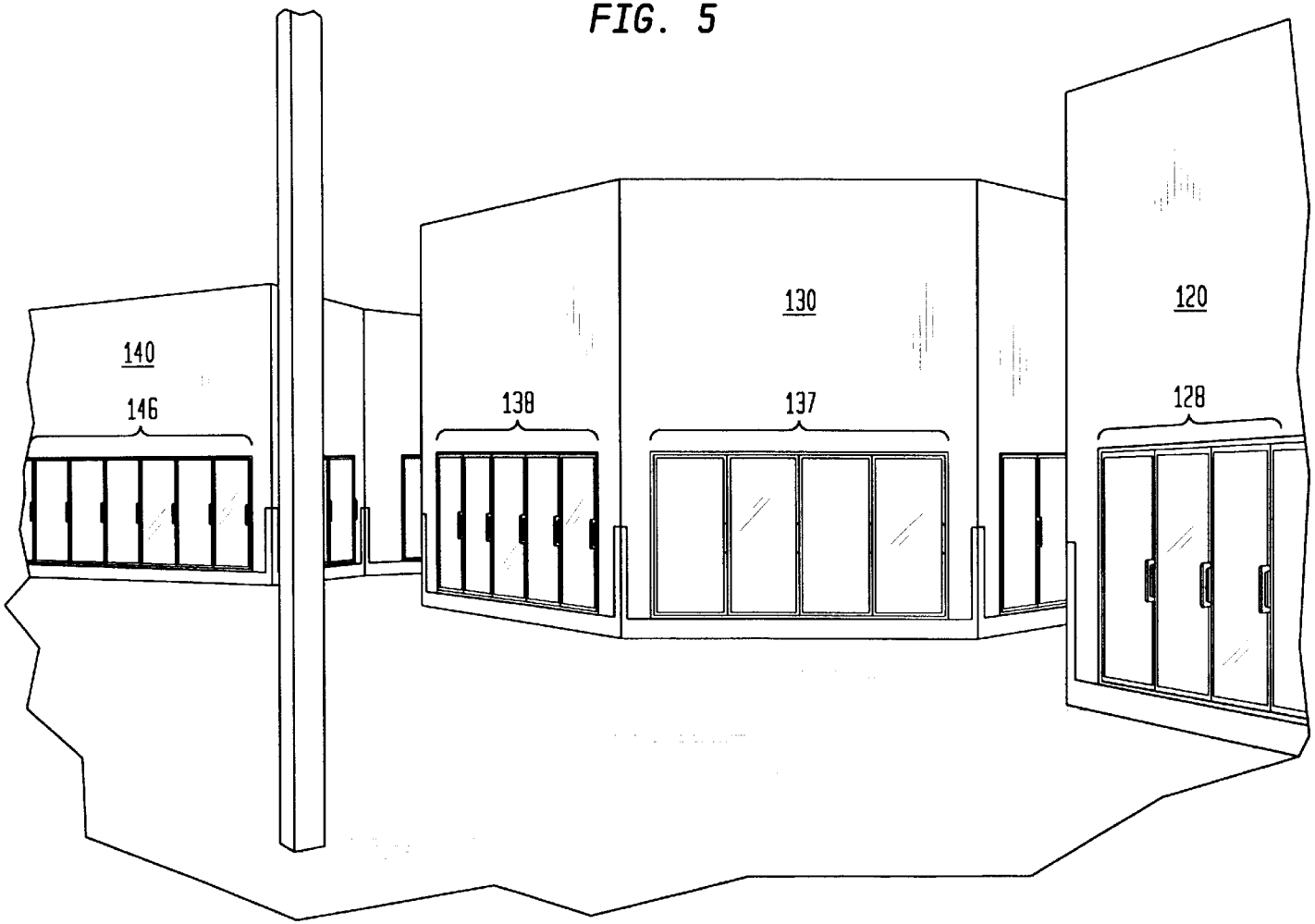
FIG. 5 shows details of first, second, and third freezers or coolers from a point approximately located along the line of sight B—B of FIG. 2.

FIG. 5 shows freezers 120, 130 and 140 viewed from a point located approximately along a line of sight B—B of FIG. 2. Freezer doors 128 of freezer 120, as well as doors 137 and 138 of freezer 130 and doors 146 of freezer 140 can be readily seen. By contrast, as seen for the bank of freezers 800 of FIG. 8, any doors on end 822 of freezer 820 will be seen at a glancing angle at best when viewed from a point along line of sight B'—B' with an angle of view similar to that illustrated in FIG. 5.

Figure 6:
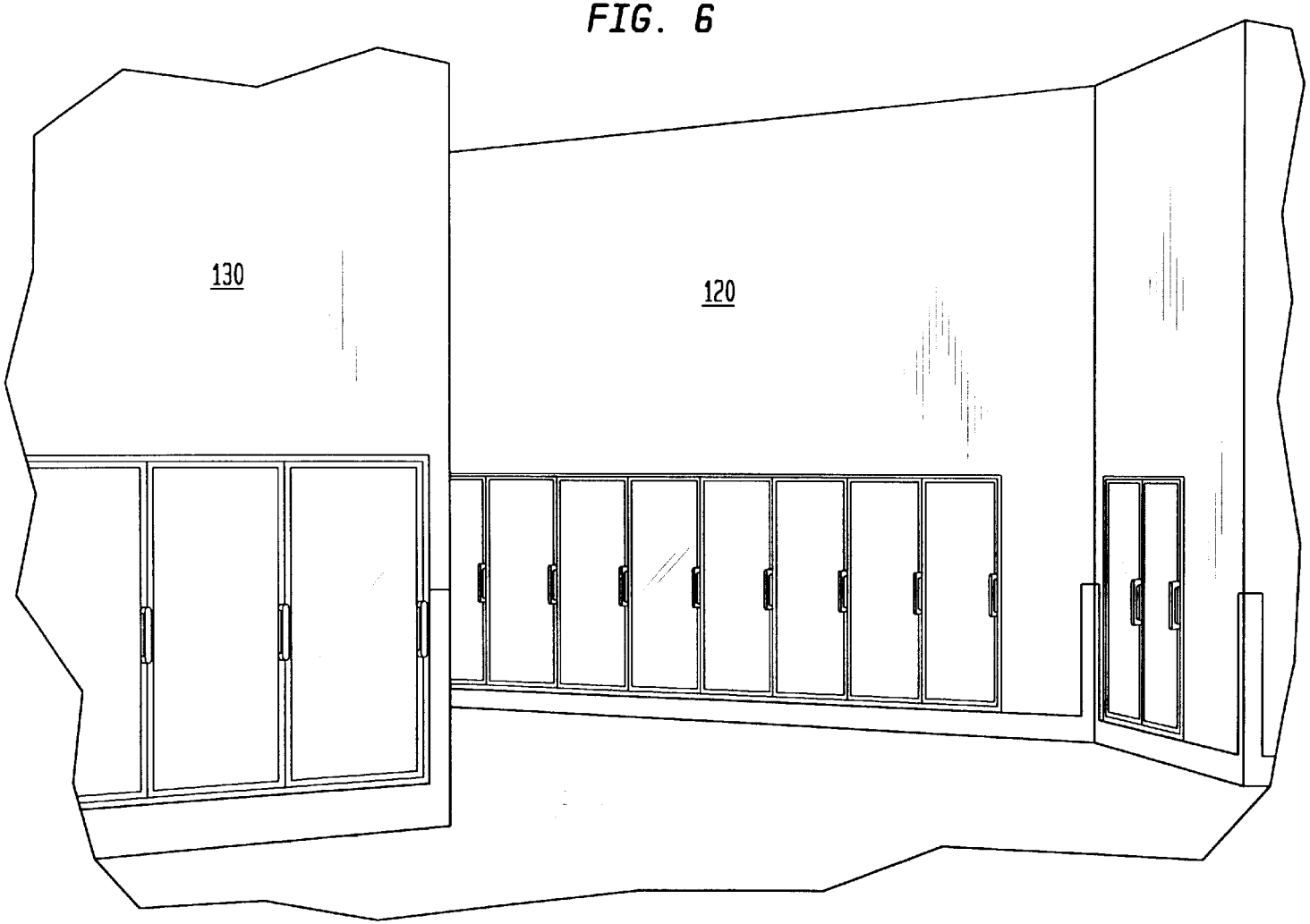
FIG. 6 shows details of second and third freezers or coolers from a point approximately located along the line of sight C—C of FIG. 2.

FIG. 6 shows freezers 120 and 130 viewed from a point approximately located along a line of sight C—C of FIG. 2.

Figure 7:
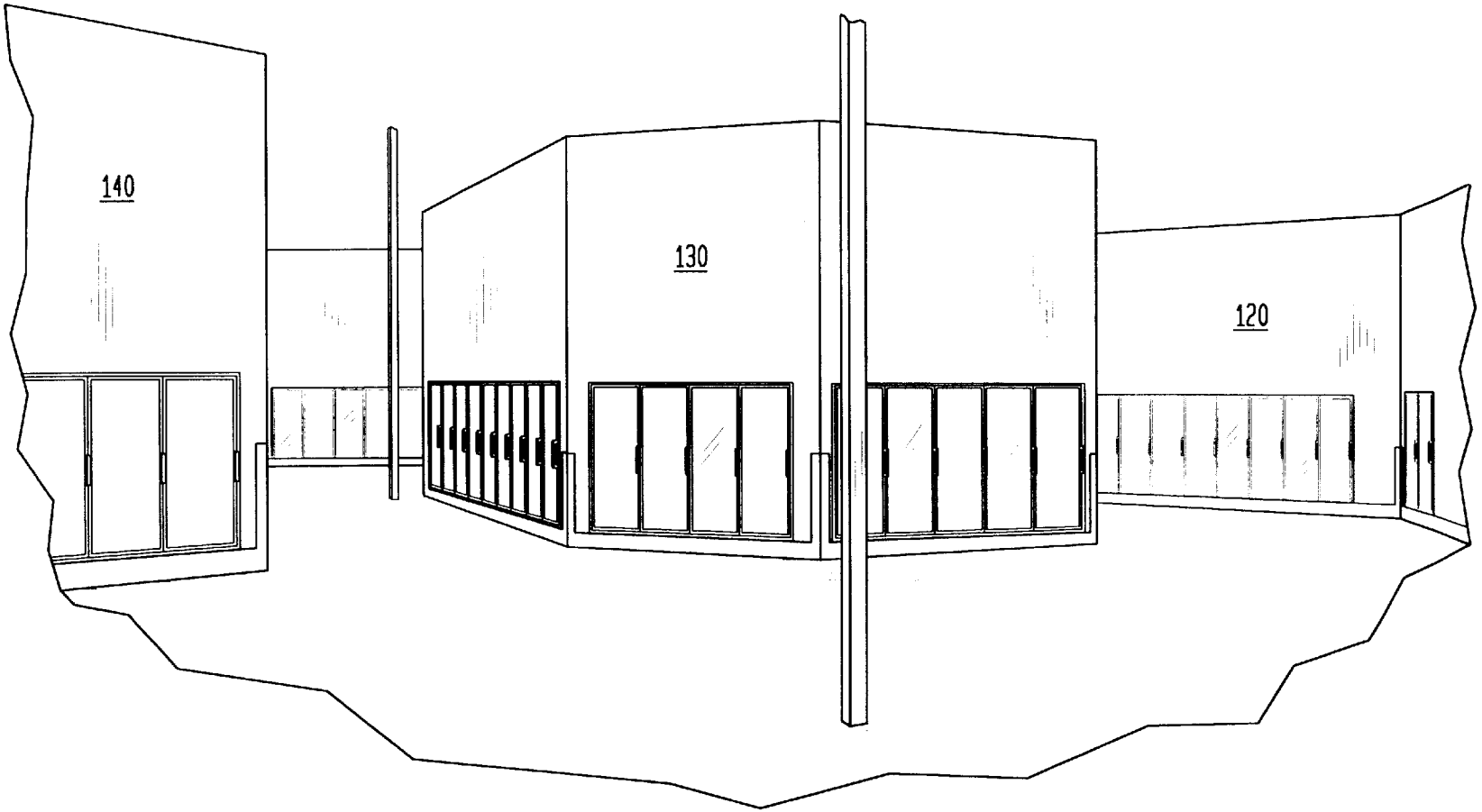
FIG. 7 shows details of first, second, and third freezers or coolers from a point approximately located along the line of sight D—D of FIG. 2.

FIG. 7 shows freezers 120, 130, and 140 viewed from a point approximately located along a line of sight D—D of FIG. 2.

Figure 8:
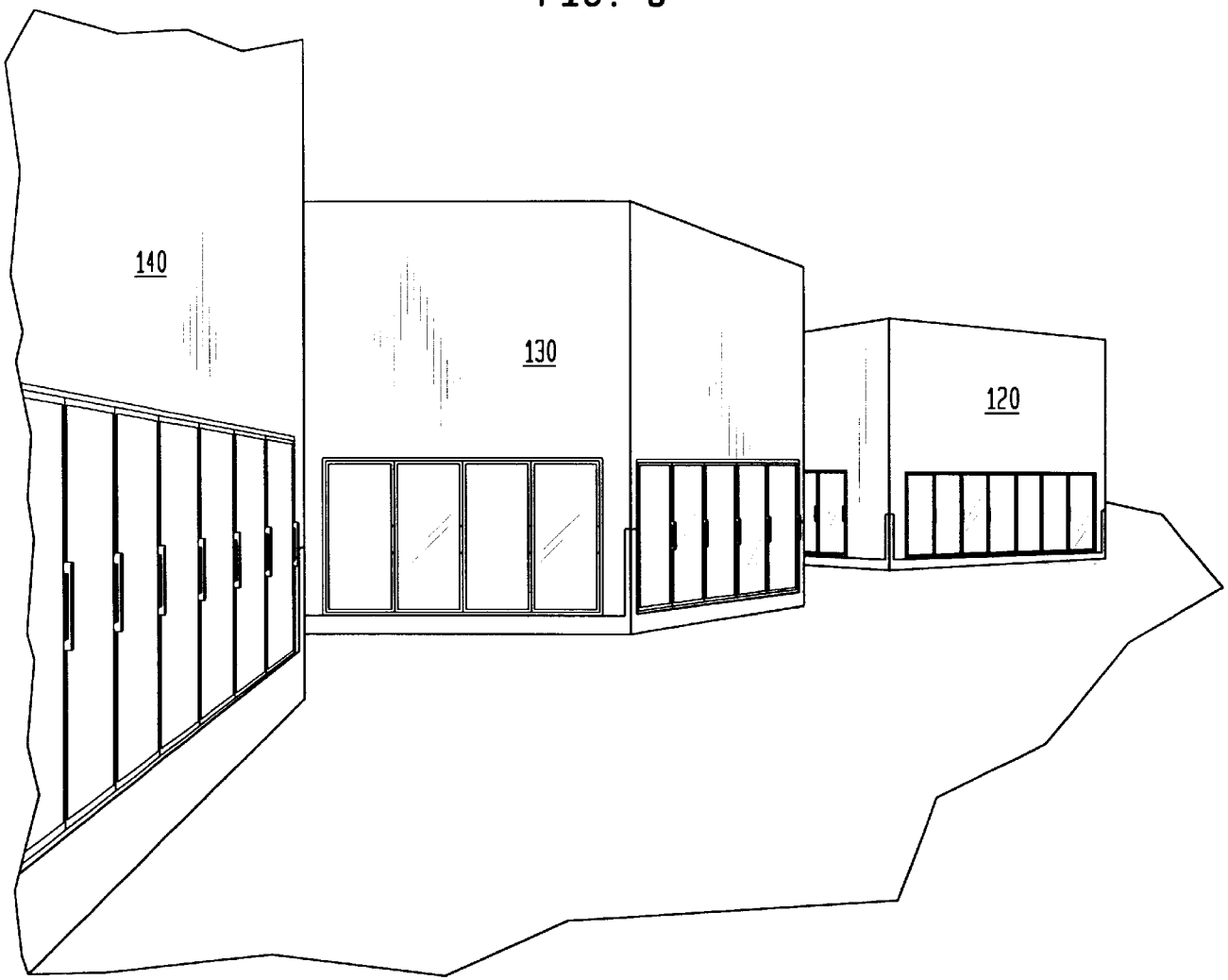
FIG. 8 shows details of first, second, and third freezers or coolers from a point approximately located along the line of sight E—E of FIG. 2.
Figure 9:
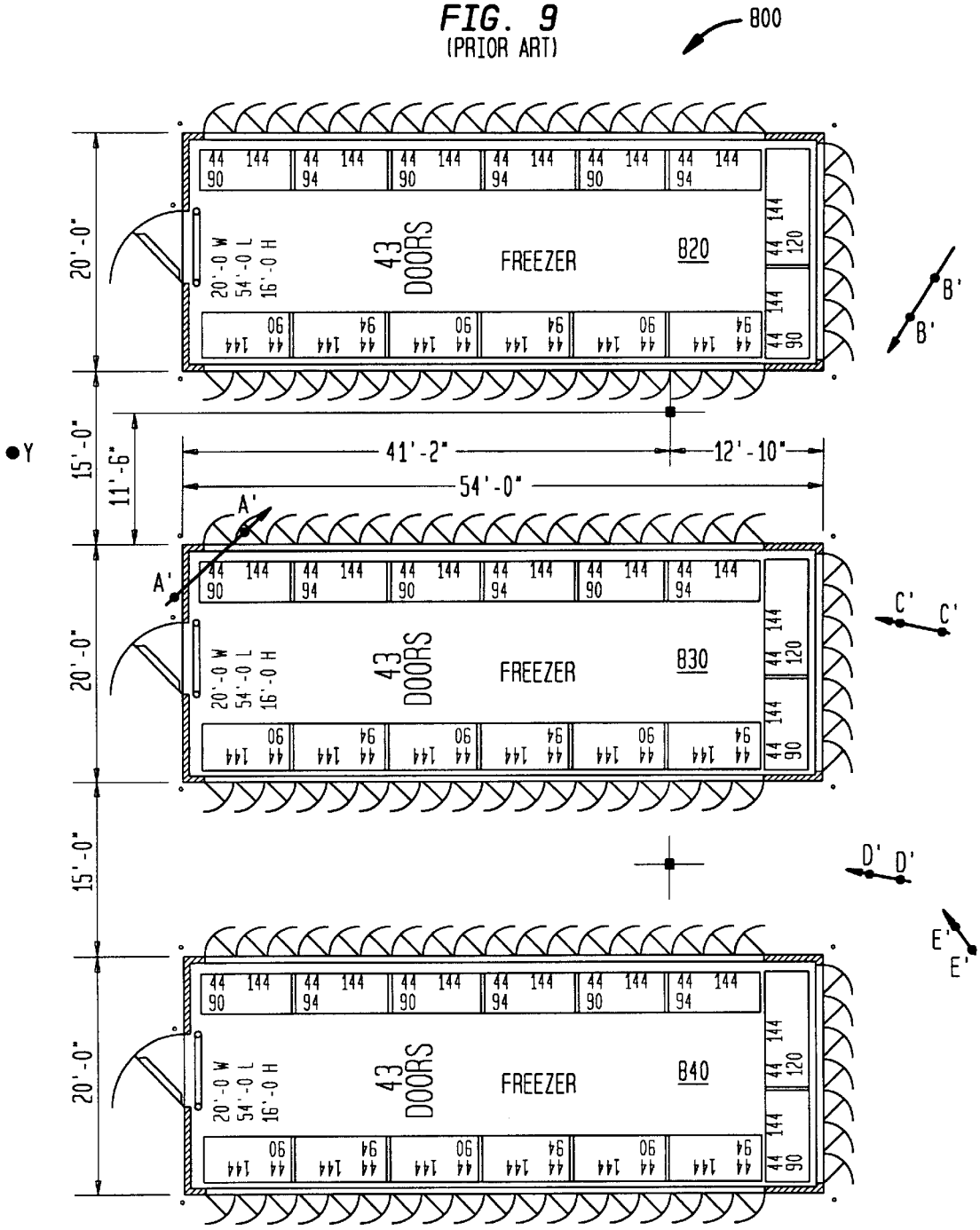
FIG. 9 (PRIOR ART)
FIG. 9 shows three rectangular arrays of freezers with lines of sight A'—A' through E'—E' for purposes of comparison.

FIG. 8 shows freezers 120, 130, and 140 from a point approximately located along a line of sight E—E of FIG. 2.

Figure 10:
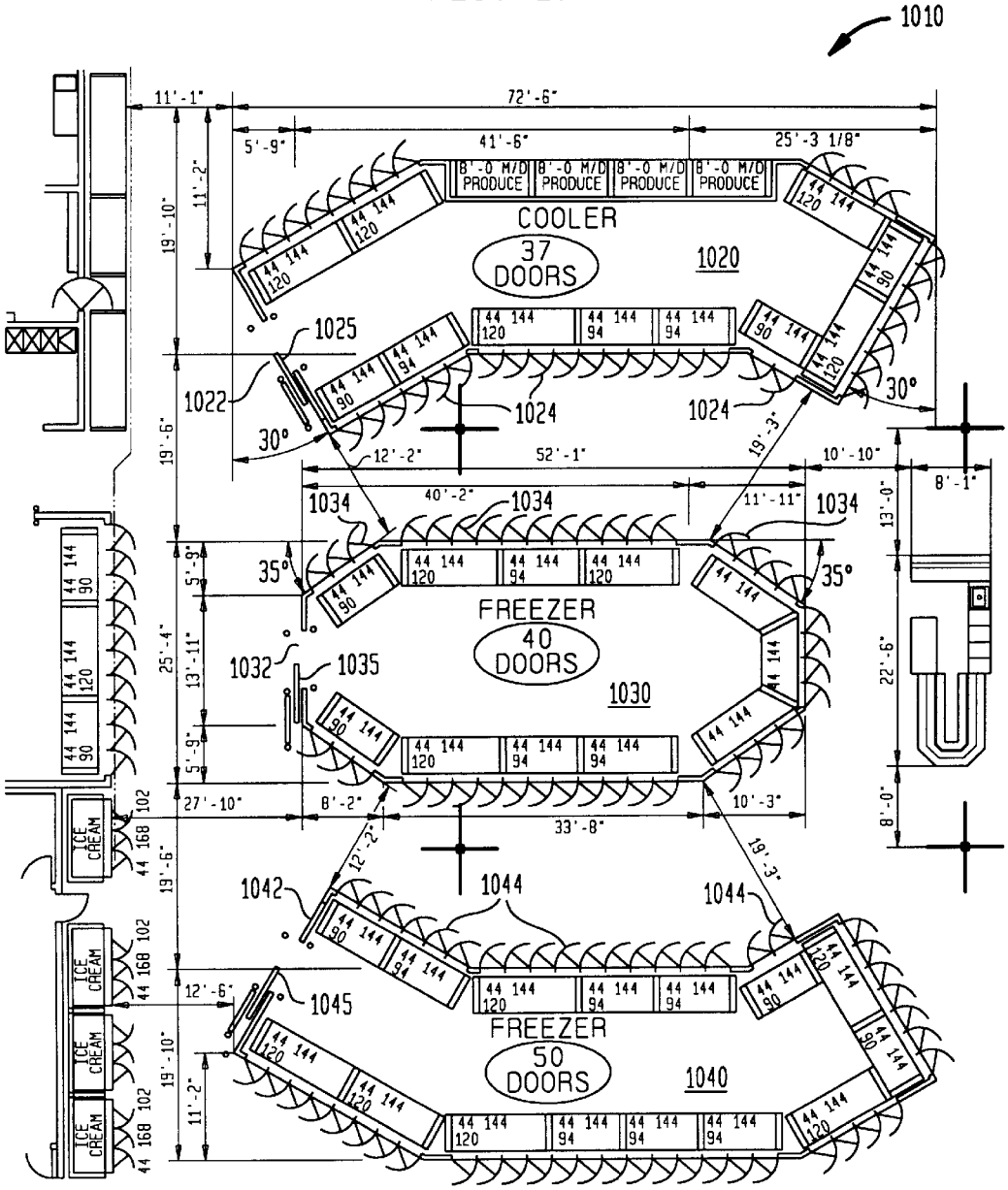
FIG. 10 shows an alternative second embodiment of a freezer or cooler bank in accordance with the present invention.

FIG. 10 illustrates a bank of freezers 1010 in accordance with an alternative embodiment of the present invention. Bank of freezers 1010 includes three curved or angled freezers or coolers 1020, 1030, and 1040, respectively. While it will be understood that each unit 1020, 1030, or 1040 can be a freezer, a cooler, any other refrigeration unit or some combination thereof, unit 1020 is preferably a cooler with 37 doors, unit 1030 is a freezer with 40 doors, and unit 1040 is a freezer with 50 doors. Each of the units includes at least one portion angled with respect to an immediately adjoining portion at an angle substantially different from 90°.

Each of the units 1020, 1030, and 1040, respectively, is formed from a plurality of individual storage compartments and doors 1024, 1034, 1044, arranged as seen in FIG. 10. In the arrangement shown, each of the freezers has angled or curved portions to enhance viewability of products by shoppers as addressed in detail above. At the ends 1022, 1032, and 1042, doors 1025, 1035, and 1045 are provided to provide access for restocking of the respective freezers. In a warehouse club type of store, sufficient room is provided for a forklift to drive in between the interior of individual freezers in a known fashion. In a presently preferred embodiment, the entirety of the interior of each of the cooler 1020 and the freezers 1030 and 1040 is cooled as a single unit by cold air piped to the unit from a cooling unit outside the store.

While the present invention is disclosed in a presently preferred context, it will be recognized that the teachings of the present invention may be variously embodied consistent with the disclosure and claims. By way of example, the present invention is disclosed in connection with specifically preferred embodiments in which the inventive freezer bank is adapted to a warehouse store or club, such as Sam's Club™, for example. It will be recognized that the present invention may be variously adapted to other environments presenting the same or similar problems and to which the present advantageous solutions will be readily applicable by those of ordinary skill in the art in light of the present teachings. Further, while specific exemplary details of presently preferred freezers are provided, it will be recognized that other freezers, coolers, or refrigeration units can be utilized as suited to a store environment.

We claim:

1. A bank of freezers having enhanced viewability comprising:

a plurality of individual freezers each having at least two ends;

each of said freezers including at least two angled sections at each end which are angled at an angle substantially different than 90°; and said freezers arranged on a store floor with respect to one another so as to allow customers to freely travel between said freezers.

2. The apparatus of claim 1 wherein each of the individual freezers are built into an overall housing and containing cold air to cool products extending substantially above the tops of individual product access doors, the housing concealing shelves for restock inventory.

3. The apparatus of claim 2 wherein each of said freezers further includes an open central area sufficiently wide to allow access for restocking and a door to access the open central area.

4. The apparatus of claim 3 wherein said plurality of freezers comprises at least three freezers.

5. The apparatus of claim 4 wherein one of said plurality of freezers is a centrally located freezer having first and second flat sides and two rounded ends connecting the first and second flat sides.

6. The apparatus of claim 5 wherein two additional ones of said plurality of freezers are generally C-shaped freezers arranged on either side of the centrally located freezer with the curves of the C-shapes generally paralleling the rounded ends of the centrally located freezer.

7. The apparatus of claim 5 wherein the centrally located freezer includes at least 30 doors providing access to products stored in centrally located freezers.

8. The apparatus of claim 6 wherein each of the generally C-shaped freezers includes at least 40 doors providing access to products stored in the generally C-shaped freezers.

9. The apparatus of claim 1 wherein said angle is selected so that a viewer can readily view products at each end of at least three different freezer from many different view points.

10. The apparatus of claim 1 in which said bank of freezers have a sufficient height so that said customers cannot see over said bank of freezers.

* * * * *